US006386776B2

(12) United States Patent
Scariano

(10) Patent No.: US 6,386,776 B2
(45) Date of Patent: May 14, 2002

(54) LOTION APPLICATOR

(76) Inventor: Marlene Mistich Scariano, 206 Pineland Dr., Mandeville, LA (US) 70471

( * ) Notice: Subject to any disclaimer, the term of this patent is extended or adjusted under 35 U.S.C. 154(b) by 0 days.

(21) Appl. No.: 09/790,241

(22) Filed: Feb. 21, 2001

Related U.S. Application Data

(63) Continuation-in-part of application No. 09/564,446, filed on May 4, 2000, now abandoned.

(51) Int. Cl.[7] ..... B05C 17/00

(52) U.S. Cl. ..... 401/8; 15/222; 206/225; 206/229; 206/390; 206/581; 206/823; 224/148.6; 401/118; D28/7

(58) Field of Search ..... 401/8, 6, 49, 118; 15/222, 244.1, 244.2, 244.4; 601/137, 138, 143; D28/7; 206/225, 229, 230, 581, 390, 823; 224/148.1, 148.6

(56) References Cited

U.S. PATENT DOCUMENTS

| | | | | | |
|---|---|---|---|---|---|
| 3,699,980 | A | * | 10/1972 | Carpenter | 401/6 X |
| 4,129,391 | A | | 12/1978 | Gamacher | |
| 4,299,005 | A | | 11/1981 | Brown | |
| 4,396,028 | A | | 8/1983 | Waggoner | |
| D289,564 | S | | 4/1987 | Harford | |
| 4,869,612 | A | | 9/1989 | Mooney et al. | |
| D307,490 | S | | 4/1990 | Thieroff, Jr. et al. | |
| D310,270 | S | | 8/1990 | Bacal et al. | |
| 5,087,138 | A | | 2/1992 | Terbrusch et al. | |
| D332,153 | S | | 12/1992 | Butler | |
| 5,251,990 | A | * | 10/1993 | Vought et al. | 401/8 |
| D342,583 | S | | 12/1993 | King | |
| 5,360,111 | A | | 11/1994 | Arispe | |
| D353,223 | S | | 12/1994 | Moore | |
| D355,726 | S | | 2/1995 | Delmerico | |
| D360,705 | S | | 7/1995 | Martin | |
| 5,493,749 | A | | 2/1996 | Zayas | |
| 5,573,342 | A | | 11/1996 | Patalano | |
| 5,615,962 | A | | 4/1997 | Staub | |
| 5,664,281 | A | | 9/1997 | Pelfrey | |
| 5,736,213 | A | * | 4/1998 | Meier | 401/8 X |
| 5,810,027 | A | | 9/1998 | Frantzeskakis | |

* cited by examiner

*Primary Examiner*—David J. Walczak
*Assistant Examiner*—Kathleen J. Prunner
(74) *Attorney, Agent, or Firm*—Kenneth L Tolar

(57) ABSTRACT

A lotion applicator includes an elongated, substantially planar strip constructed with a pliable, non-absorbent foam material. Adjacent each end of the strip is an aperture for receiving a user's finger or thumb. A user can apply lotions, ointments and similar viscous substances to otherwise inaccessible areas of the user's body by placing the viscous substance onto the strip. A user then grasps the strip by inserting a thumb or finger from each hand into each of the apertures. The user can then easily maneuver the strip across the back or other hard to reach locations of the user's body.

3 Claims, 2 Drawing Sheets

LOTION APPLICATOR

This application is a continuation-in-part of application Ser. No. 09/564,446 filed May, 4, 2000, now abandoned.

BACKGROUND OF THE INVENTION

The present invention relates to a lotion applicator that allows an unassisted user to apply lotions, oils, ointments, medication and similar gelatinous substances to otherwise inaccessible areas of the user's body.

DESCRIPTION OF THE PRIOR ART

Applying lotions, oils, ointments and similar viscous substances to inaccessible areas such as a user's back have typically been impossible without the assistance of another person. Often sunbathers, patients and similar persons needing to apply lotions to such inaccessible areas may be alone or otherwise unable to be assisted by another person. Accordingly, there is currently a need for a device that allows one to easily and conveniently apply lotions and similar substances to otherwise inaccessible areas of a user's body.

A myriad of lotion applicators have been designed to address the above described problem. For example, U.S. Pat. No. 5,013,171 issued to Almond, II discloses a lotion applicator including a cylindrical housing having a continuous web retractably received therein. The web is retracted through a lip that cooperates with an absorbent, sponge-like roller to maintain lotion on the web.

U.S. Pat. No. 5,736,213 issued to Meyer discloses an elongated non-absorbent body having elastomeric handles on each of two opposing ends thereof.

Although various somewhat similar devices exist in the prior art, conventional devices such as those described above have several disadvantages. For example, the device disclosed in Meyer includes a somewhat thick, elongated body with a loop attached to each end that is more difficult and expensive to manufacture. Furthermore, the thickness of the body and loops make the device difficult, if not impossible, to compactly fold for storage. Finally, repeated grasping and pulling of the loops result in significant wear and tear thereby significantly reducing the effective life of the applicator.

The present invention overcomes the above described disadvantages of conventional applicators by providing a relatively thin strip of non-absorbent foam having an aperture adjacent each end thereof. By inserting a finger or thumb from each hand into an aperture, a user can quickly and easily maneuver the applicator throughout otherwise inaccessible locations of a user's body. Furthermore, the device can be compactly rolled for storage.

SUMMARY OF THE INVENTION

The present invention relates to a lotion applicator including an elongated strip formed of a pliable, non-absorbent material such as PVC foam. The strip includes two opposing ends, a rear surface and a front surface. Adjacent each end of the strip is an aperture for receiving a user's finger or thumb. A user grasps the device by inserting a thumb or finger from each hand into one of the apertures. The user can then easily maneuver the strap to reach various otherwise inaccessible areas of the user's body. It is therefore an object of the present invention to provide a lotion applicator that is simple and inexpensive to manufacture. It is another object of the present invention to provide a lotion applicator that is durable and easy-to-use. It is yet another object of the present invention to provide a lotion applicator that can be completely and compactly furled for storage.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
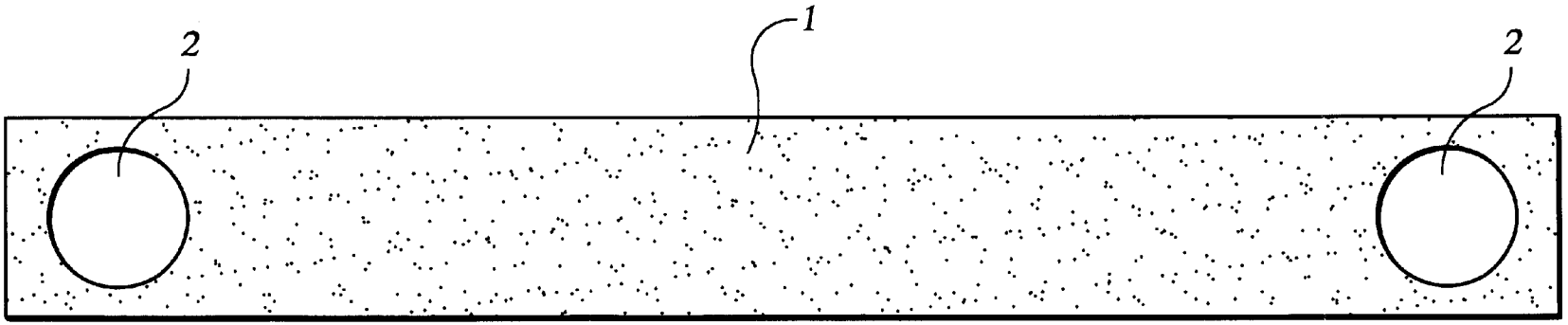
FIG. 1 is a plan view of the lotion applicator.

Now referring to FIG. 1, the present invention relates to a lotion applicator that allows a user to easily and conveniently apply lotions and similar materials to otherwise inaccessible areas of a user's body. The applicator includes an elongated, substantially rectangular strip 1 having two opposing ends, a front surface and a rear surface. Adjacent each of the two ends is an aperture 2 for receiving a user's finger or thumb. The strip is preferably manufactured with a pliable, non-absorbent material such as polyvinyl chloride. The polyvinyl chloride allows a lotion, ointment, medication or similar substance to be applied to either the front or rear surface of the strip without being absorbed thereby. Accordingly, virtually all of the lotion applied to the strip will be subsequently applied to a user as opposed to being absorbed by the applicator.

Figure 2:
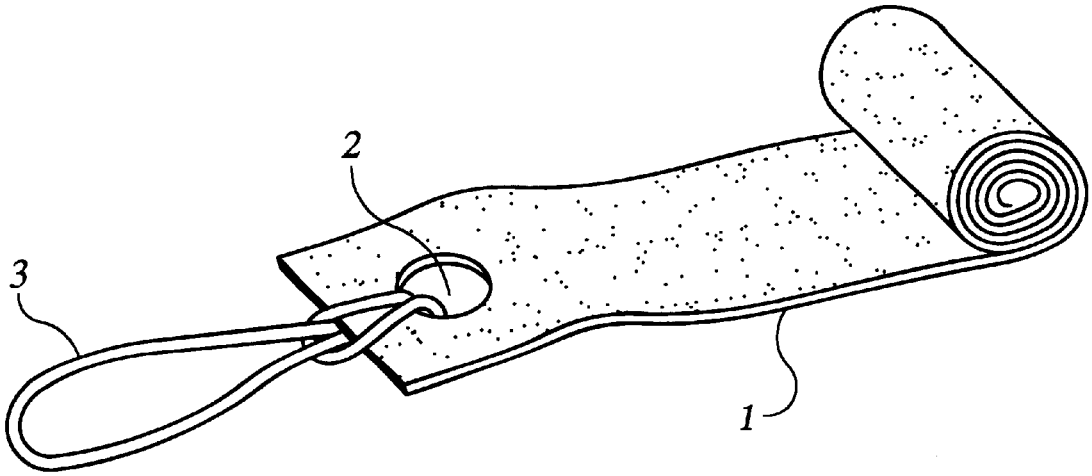
FIG. 2 is a perspective view of the lotion applicator in a partially furled position.
Figure 3:
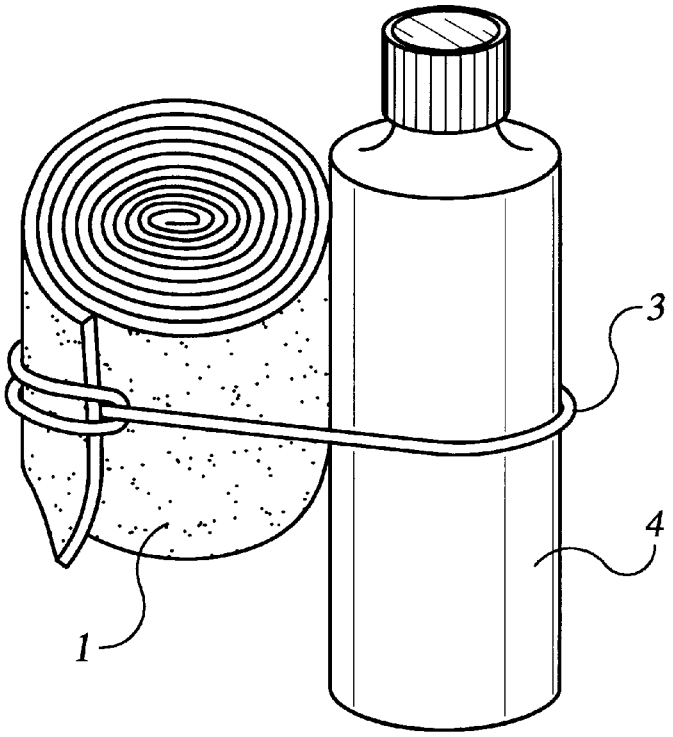
FIG. 3 is a perspective view of the lotion applicator in a completely furled position and secured to a lotion container.

Now referring to FIGS. 2 and 3, the minimal thickness of the strip in combination with the pliable foam like material allows the device to be spirally furled for storage. In addition, an elastomeric band 3 or similar object may be secured within one of the apertures and placed about the strip allowing the strip to be secured in the completely furled position. Furthermore, the elastomeric band can be placed about both the strip and a lotion container 4 allowing the lotion applicator and container to be simultaneously transported.

As described above, the strip is preferably constructed with a pliable non-absorbent foam material such as PVC. Preferably, the thickness of the strip is minimal allowing the device to be easily and compactly folded for storage. Although the strip is described and depicted as being substantially rectangular, the shape of the strip can be varied. Furthermore, as will be readily apparent to those skilled in the art, the size, shape and materials of construction of the above described device can be varied without departing from the spirit thereof.

What is claimed is:

1. A lotion applicator comprising:

an elongated strip of pliable, non-absorbent material, said strip having two opposing ends with an aperture proximal each of said ends for receiving a user's finger; said strip being foldable to a completely furled orientation;

an elastomeric strap secured within one of said apertures whereby said strap is securable about said strip when said strip is rolled into the completely furled position.

2. The lotion applicator according to claim 1 wherein said elastomeric strap is secured about a container allowing said container and said applicator to be tranported simultaneously.

3. The lotion applicator according to claim 1 wherein said strip is constructed with polyvinyl chloride.

* * * * *